US011731449B2

(12) United States Patent
Boettcher et al.

(10) Patent No.: US 11,731,449 B2
(45) Date of Patent: Aug. 22, 2023

(54) SYSTEM FOR COUPLING MAGNETS TO ARTICLES

(71) Applicant: Amazing Magnets, LLC, Anaheim, CA (US)

(72) Inventors: Timothy Paul Boettcher, Orange, CA (US); Luke T. Bilisoly, Fullerton, CA (US)

(73) Assignee: Amazing Magnets, LLC, Round Rock, TX (US)

( * ) Notice: Subject to any disclaimer, the term of this patent is extended or adjusted under 35 U.S.C. 154(b) by 611 days.

(21) Appl. No.: 16/946,107

(22) Filed: Jun. 5, 2020

(65) Prior Publication Data

US 2020/0384795 A1 Dec. 10, 2020

Related U.S. Application Data

(60) Provisional application No. 62/857,572, filed on Jun. 5, 2019.

(51) Int. Cl.

| | |
|---|---|
| ***B43K 23/00*** | (2006.01) |
| ***A47G 29/08*** | (2006.01) |
| ***B43L 21/00*** | (2006.01) |

(52) U.S. Cl.

CPC ..... *B43K 23/001* (2013.01); *A47G 29/08* (2013.01); *A47G 2200/106* (2013.01); *B43L 21/00* (2013.01)

(58) Field of Classification Search

CPC ..... B43K 23/001; B43L 21/00; A47G 29/08; A47G 2200/106

(Continued)

(56) References Cited

U.S. PATENT DOCUMENTS

| | | | |
|---|---|---|---|
| 505,733 | A | 9/1893 | Torrey |
| 1,943,647 | A | 1/1934 | Weller |

(Continued)

FOREIGN PATENT DOCUMENTS

| | | |
|---|---|---|
| CN | 204095369 | 1/2015 |
| EP | 1 543 993 A1 | 6/2005 |

(Continued)

OTHER PUBLICATIONS

"The StikkiWorks Co.—Magnetic Marker Rings", http://www.stikkiworks.com/prodring, printed from the internet Dec. 11, 2015.

*Primary Examiner* — J. Gregory Pickett
*Assistant Examiner* — Niki M Eloshway
(74) *Attorney, Agent, or Firm* — Knobbe Martens Olson & Bear, LLP

(57) ABSTRACT

A modular assembly that is configured to be magnetically coupled to another object, such as a white board or glass board, is provided. The magnetic strength of the modular assembly can be adjusted. The modular assembly includes an article, such as a tray or other type of holder for receiving materials like markers and papers, and a module that houses magnets. The article can include a magnet housing portion with a magnet housing retention feature. The module can include a magnet housing with one or more magnets held therein. The magnet housing can include an article coupling feature. The module can slide into the magnet housing portion of the article and be secured in place by the engagement of the magnet housing retention feature and the article coupling feature.

16 Claims, 12 Drawing Sheets

(58) Field of Classification Search
USPC ..... 220/476
See application file for complete search history.

(56) References Cited

U.S. PATENT DOCUMENTS

| | | | | |
|---|---|---|---|---|
| 2,297,806 | A | 10/1942 | Smith | |
| 2,385,859 | A | 10/1945 | Jacobson | |
| 2,644,212 | A | 7/1953 | Markowitz | |
| 2,964,812 | A | 12/1960 | Cook | |
| 3,159,372 | A | 12/1964 | McIntosh | |
| 3,387,341 | A | 6/1968 | Mates et al. | |
| 4,941,226 | A | 7/1990 | Kemper | |
| 5,083,337 | A | 1/1992 | Jones | |
| 6,199,240 | B1 | 3/2001 | You | |
| D441,021 | S | 4/2001 | Roush | |
| 6,305,864 | B1 | 10/2001 | Nguyen | |
| 6,718,708 | B2 | 4/2004 | Donoghue | |
| D493,836 | S | 8/2004 | Cegelski et al. | |
| 6,846,122 | B1 | 1/2005 | Liao | |
| 6,945,503 | B2 | 9/2005 | Cohen | |
| 7,264,414 | B2 | 9/2007 | McReynolds et al. | |
| 7,313,841 | B2 | 1/2008 | Huang | |
| 7,496,994 | B1 | 3/2009 | Headley | |
| 7,527,447 | B2 | 5/2009 | Huang | |
| 7,618,013 | B2 | 11/2009 | Elmer et al. | |
| 8,235,262 | B1 | 8/2012 | Sakdol | |
| 8,439,585 | B2 | 5/2013 | Rubio | |
| 8,464,447 | B2 | 6/2013 | Pemberton | |
| 9,153,152 | B1 | 10/2015 | Elmer | |
| 9,161,586 | B2 | 10/2015 | Brown | |
| 9,320,409 | B1 | 4/2016 | Lu et al. | |
| 9,409,437 | B2 | 8/2016 | Green et al. | |
| 9,662,926 | B1 | 5/2017 | Boettcher et al. | |
| 10,130,194 | B1 * | 11/2018 | Lai | B25H 3/04 |
| 10,220,649 | B2 | 3/2019 | Boettcher et al. | |
| 11,059,164 | B2 * | 7/2021 | Winnard | G09F 3/02 |
| 11,273,665 | B2 | 3/2022 | Boettcher et al. | |
| 11,345,182 | B2 | 5/2022 | Boettcher et al. | |
| 2004/0205919 | A1 | 10/2004 | Sims | |
| 2005/0251942 | A1 | 11/2005 | Gunnarson | |
| 2006/0000043 | A1 | 1/2006 | Jou-Chen et al. | |
| 2006/0194028 | A1 | 8/2006 | Moore | |
| 2007/0014624 | A1 | 1/2007 | Fogelson et al. | |
| 2007/0194187 | A1 | 8/2007 | Amron | |
| 2008/0166173 | A1 | 7/2008 | Gibbons | |
| 2008/0240840 | A1 | 10/2008 | Huang | |
| 2009/0126137 | A1 | 5/2009 | Lyons | |
| 2009/0193629 | A1 | 8/2009 | Suenaga | |
| 2010/0068422 | A1 | 3/2010 | Keyes | |
| 2010/0219217 | A1 | 9/2010 | Andochick | |
| 2011/0091860 | A1 | 4/2011 | Supera et al. | |
| 2013/0306206 | A1 | 11/2013 | Quinnan | |
| 2016/0186789 | A1 | 6/2016 | Nelson et al. | |
| 2016/0220088 | A1 | 8/2016 | Zohar et al. | |
| 2017/0086614 | A1 * | 3/2017 | Ross | A47G 23/03 |
| 2017/0259612 | A1 | 9/2017 | Boettcher et al. | |
| 2018/0056710 | A1 | 3/2018 | Boettcher et al. | |
| 2018/0202602 | A1 * | 7/2018 | Conti | A47G 23/02 |
| 2019/0023057 | A1 * | 1/2019 | Davies-Smith | B43K 7/12 |
| 2020/0023671 | A1 | 1/2020 | Boettcher et al. | |
| 2021/0316900 | A1 * | 10/2021 | Burt | B65D 83/0445 |
| 2022/0204249 | A1 * | 6/2022 | LaMance | B65D 81/3881 |

FOREIGN PATENT DOCUMENTS

| | | | | |
|---|---|---|---|---|
| EP | 3 067 876 | B1 | 12/2017 | |
| EP | 3 079 140 | B1 | 10/2018 | |
| FR | 2730952 | A1 * | 8/1996 | B43L 21/00 |
| FR | 2 825 594 | | 12/2002 | |
| GB | 273413 | A | 7/1927 | |
| KR | 20-0321360 | | 7/2003 | |
| KR | 10-0946430 | | 3/2010 | |
| KR | 10-2013-0137873 | | 12/2013 | |
| WO | WO 2017/083374 | | 5/2017 | |
| WO | WO 2018/039177 | | 3/2018 | |

* cited by examiner

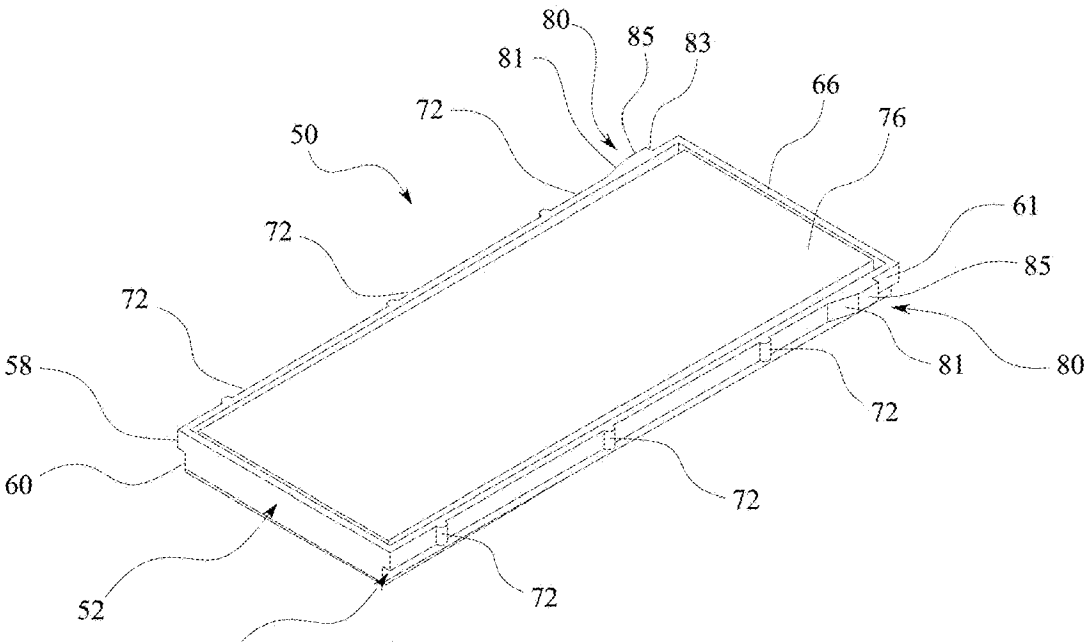
50
72
72
72

SYSTEM FOR COUPLING MAGNETS TO ARTICLES

INCORPORATION BY REFERENCE TO ANY PRIORITY APPLICATIONS

The present application claims priority benefit under 35 U.S.C. § 119(e) to U.S. Provisional Application No. 62/857,572, filed Jun. 5, 2019, which is hereby incorporated by reference herein in its entirety.

BACKGROUND

Field

The present disclosure relates to a system for coupling magnets to articles to facilitate coupling with other articles and structures.

Description of the Related Art

Blackboards and whiteboards have long been in use. These devices provide a convenient space for instructors and meeting attendees to record their thoughts for a group using chalk and pens. Whiteboard, and more recently glassboards, have gained popularity as more convenient and cleaner to use than blackboards. Glassboards, which are gaining in popularity form part of, or are mounted to a wall surface. A layer of glass is the structure upon which the user writes. These devices improve on whiteboards in being more durable, and being more aesthetically pleasing with a sleek, modern look.

A conventional way to mount articles, such as trays for holding markers and other materials, in close proximity to a blackboard or whiteboard, is to attach the article to the bottom edge of the board using mechanical fasteners. The position of the article may be fixed relative to the board and may not be removable without the use of tools. Sometimes articles are provided with integrated magnets as part of an assembly or to hold the article vertically.

SUMMARY

However, the user may wish to store more items in an article than the strength of fixed, integrated magnets can support, causing the article to slide relative to the board or to even fall off of the board completely. The desired magnetic strength of a magnetic article can also vary depending on the type of product to which the article is to be magnetically coupled or mounted. Example applications can include, without limitation, an object comprising porcelain coated steel, painted steel, epoxy coated steel, a ferrous metal, a ferrous backed glass, and/or a ferrous backed plastic. Non-limiting examples of such objects are whiteboards, glass boards, steel filing cabinets, steel shelfing, and/or sheet metal. Accordingly, there is a need for a modular system for attaching magnets to articles such as trays or other holders for storing materials (e.g., markers, papers, etc.) such that the magnetic strength of article is adjustable.

Module systems are disclosed for attaching magnets to consumer products or other devices with locking or fastening features that can be independent from the magnets themselves. In some embodiments, the system can have magnet(s) embedded or permanently attached to a housing.

The housing may have attaching features that can be used to mount, fasten, or snap the module into a larger product (e.g., as shown in FIG. 4).

Attaching features on the housing may include countersunk holes for screws, threaded inserts, plastic snap joints (e.g., as shown in FIG. 6A), press fit features, and/or other physical locking mechanisms.

The module may hold and/or contain multiple magnets and miscellaneous components.

Adjustable Strength:

The housing may contain features to retain (or not retain) a number of magnets (for example, as shown in FIG. 6A). In an example, supporting capability of an assembly including the housing can be increased or decreased. A single magnet can be coupled with one of three holes for a first lower level of supporting capability. Two magnets can be coupled with housing, one magnet per hole in two of the three holes, to increase the supporting capability to a second higher supporting capability. One magnet can be coupled with each of the holes to further increase the supporting capability to a third, still higher supporting capability. Further modularity can be provided by selecting stronger or weaker magnets in the holes to provide additional variation in supporting capability. In other words, the housing can be configured to selectively receive magnets as needed for greater or lesser magnetic strength.

This can advantageously allow for adjustability of the magnetic strength of the module by increasing or reducing the number of magnets inside the module, or by increasing or decreasing the size, material, or grade of the magnets inside the module.

Modular System:

The module may be used in multiple products. For example, in some embodiments, the module may be used in multiple disparate products without the need to create specific tooling for each product.

Time Savings and Ease of Assembly:

The device may save time by behaving as a pre-assembled sub-assembly. The sub-assembly may be a complete unit where one operation can be performed to attach multiple components to a product. The magnetic module can be built and magnetized prior to coupling to an article (e.g., pre-magnetized), and later coupled without tools to the article (e.g., an article that may be too large to be magnetized). The modular assembly can be produced in factories that may not have the expertise and/or time needed to otherwise properly install magnets into the article and/or modular assembly (e.g., pre-magnetized modules can be coupled to articles in factories or other assembly locations without the use of tools, magnetizing equipment, etc.).

Safety:

The modules can be configured for easy assembly (e.g., when attaching the modules to the article) and/or very difficult removal (e.g., removal of the modules from the article). This can increase the safety factor of the modular assembly.

Cost Savings:

Machining fastening features into magnets can be costly. The device may advantageously allow cheaper magnet shapes, such as solid cylinders or rectangular blocks, to be used. The fastening features for holding the magnets in place may be relegated to the housing.

Safety Improvement:

Small magnets may be a choking hazard if they are dislodged from a product. Solutions such as sonic welding, overmolding, or insert molding are not available for products that are too large to fit into the magnetization machines as these solutions require a post assembly magnetization.

The module system may allow an intermediate module to permanently house the magnet using one of the attaching solutions described above while also being larger than the choking hazard limit. Then if the module is dislodged from the larger part it will still not be a choking hazard.

In some embodiments, a modular tray assembly is provided that includes a tray and a plurality of magnetic modules. The tray can include a storage compartment for storing items. The tray can include a plurality of magnetic module holders. The magnetic module holders can be disposed on a rear portion of the tray. Each of the magnetic module holders can comprise a slot and a module retention feature. Each of the magnetic modules can be configured to couple to one of the plurality of magnetic module holders of the tray. Each of the plurality of magnetic modules can include a magnet housing. The magnet housing can include a plurality of apertures. The magnet housing can include a first step on a first lateral side of the magnet housing and a second step on a second lateral side of the magnet housing opposite the first lateral side. The first and second steps can be configured to be positioned in the slot of the magnetic module holders of the tray. The magnet housing can include a tray coupling feature. The tray coupling feature can be configured to be deflected upon insertion of the magnetic module into the magnetic module holder and thereafter to be positioned against the module retention feature of the magnetic module holders of the tray such that the module retention feature blocks egress of the tray coupling feature. The magnet housing can include one or more magnets. Each magnet can be received in one aperture of the plurality of apertures of the magnet housing.

The magnet housing can include a plurality of deflectable portions that allow the magnet housing to flex under pressure. The plurality of deflectable portions can comprise a plurality of spaced apart projections. The projections can be disposed along one or both of the first and second lateral sides of the magnet housing. The plurality of deflectable portions can comprise an elongate slot. The elongate slot can extend at least partially through a thickness of the magnet housing. The elongate slot can be disposed inward of the tray coupling feature. The plurality of deflectable portions can comprise curved protrusions of a rim that extends around a periphery of the magnet housing. The curved protrusions can be disposed around at least a portion of the periphery.

In some embodiments, a modular tray assembly is provided that includes a tray and a plurality of magnetic modules. The tray can include a storage compartment for storing items. The tray can include a plurality of magnetic module holders disposed on a rear portion of the tray. Each of the magnetic module holders can comprise a module retention feature. Each of the magnetic modules can be configured to be coupled to one of the plurality of magnetic module holders of the tray. Each of the plurality of magnetic modules can include a magnet housing. The magnet housing can comprise a plurality of apertures. The magnet housing can comprise a tray coupling feature. The tray coupling feature can be configured to be positioned against the module retention feature of the magnetic module holder of the tray. The magnet housing can include one or more magnets. Each magnet can be received in one aperture of the plurality of apertures of the magnet housing.

One or more aperture can be left un-occupied. One or more aperture can be occupied by a non-magnetic spacer. Each non-magnetic spacer provided can be received in one aperture of the plurality of apertures of the magnet housing.

In some embodiments, a magnet housing for coupling or assembling magnets to an article is provided that includes a first side, a second side opposite the first side, and a rim or periphery disposed around the first side and/or the second side. The magnet housing can include an expanse between the first side and the second side. The expanse can have a recess disposed therein. The recess can be configured to receive a magnet therein. The magnet housing can include an article coupling feature configured to engage a magnet housing retention feature of an article.

The expanse can include a plurality of recesses formed therein (e.g., 2 recesses, 5 recesses, 6 recessses, 7 recesses, 10 recesses, etc.). Each recess of the plurality of recesses can be configured to receive a magnet therein. The article coupling feature can include a mechanical connection. The article coupling feature can be configured to engage the magnet housing retention feature. The mechanical connection can comprise a snap joint. The length of the expanse can be larger than one to ten times the largest dimension of the recess. For example, the length of the expanse can be larger than three times the largest dimension of the recess. The length of the expanse can be larger than five times the largest dimension of the recess. The length of the expanse can be larger than seven times the largest dimension of the recess.

The expanse can include a first portion and a second portion. The first portion can extend further laterally than the second portion, forming a stepped region along a lateral edge of the magnet housing. The stepped region can be configured to cooperate with a track in the magnet housing portion of the article.

The plurality of deflectable portions can comprise a plurality of spaced apart projections disposed along a lateral edge of the magnet housing. The plurality of deflectable portions can comprise a plurality of ribs. The ribs can be disposed along the rim around at least a portion of the periphery of the rim. The rim can extend higher than a planar surface on the first side and/or the second side of the magnet housing.

A module can be provided that includes a magnet housing, a first cover, and a second cover. One or more magnets can be received in the plurality of recesses formed in the expanse of the magnet housing. The first cover can be coupled to the first side of the magnet housing. The second cover can be coupled to the second side of the magnet housing.

In some embodiments, a modular assembly is provided that includes an article or tray that has a space for receiving items and a magnet housing portion coupled with the magnet housing. The article or tray can be magnetically coupled with another object by one or more magnets disposed in one or more of a plurality of recesses formed in the expanse of the magnet housing.

The magnet housing portion of the article can include a slot having an open end. The open end can include an opening accessible from a surface or edge of the magnet housing portion. The magnet housing portion can include a closed end. The article coupling feature of the magnet housing can be engaged with the magnet housing retention feature of the article adjacent to the open end of the slot. The article or tray can include a plurality of magnet housing retention portions. The magnet housing retention portions can be configured to be coupled with the magnet housing. The magnet housing retention portions can be spaced apart along a length of the article or tray.

In some embodiments, an article assembly is provided that includes an article having a magnet housing portion coupled with the magnet housing. The article can be magnetically coupled with another object by magnets disposed in the magnet recess(es).

In some embodiments, a modular assembly is provided that includes a magnet housing and an article. The article can include a space for receiving items. The article can include a magnet housing portion. The magnet housing portion can be configured to couple to the magnet housing. The magnet housing portion can include a magnet housing retention feature.

The magnet housing can include an article coupling feature. The article coupling feature can comprise a projection extending from a lateral edge of the magnet housing. The projection can include a first surface, a second surface, and a third surface. The first surface can extend at an angle relative to the lateral edge of the magnet housing. The second surface can extend parallel to the lateral edge of the magnet housing. The third surface can extend perpendicular to the lateral edge of the magnet housing. The magnet housing retention feature can comprise a first surface, a second surface, and a third surface. The first, second, and third surfaces of the magnet housing retention feature can be configured to abut the respective first, second, and third surfaces of the article coupling feature of the magnet housing when the magnet housing is coupled to the article.

The modular assembly can be a first modular assembly that is configured to be nested with a second modular assembly such that the first modular assembly can be stacked on top of and partly within the second modular assembly. The second modular assembly can comprise an article having a magnet housing portion. The magnet housing portions of each of the first and second modular assemblies can remain accessible on respective rear portions of the modular assemblies when the modular assemblies are nested.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No aspects of this disclosure are essential or indispensable.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments. The following is a brief description of each of the drawings.

FIGS. 5A and 5B are perspective views of an embodiment of a module;

DETAILED DESCRIPTION OF CERTAIN EMBODIMENTS

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Modular Assembly

Figure 1B:
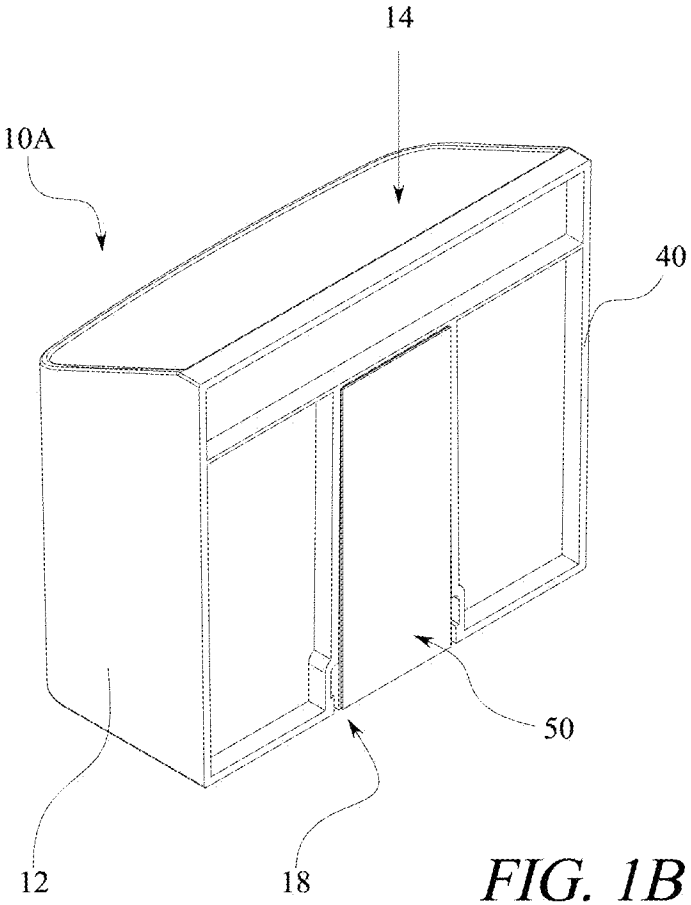
FIGS. 1A and 1B are perspective views of an embodiment of a modular assembly including an article and a module.
Figure 1A:
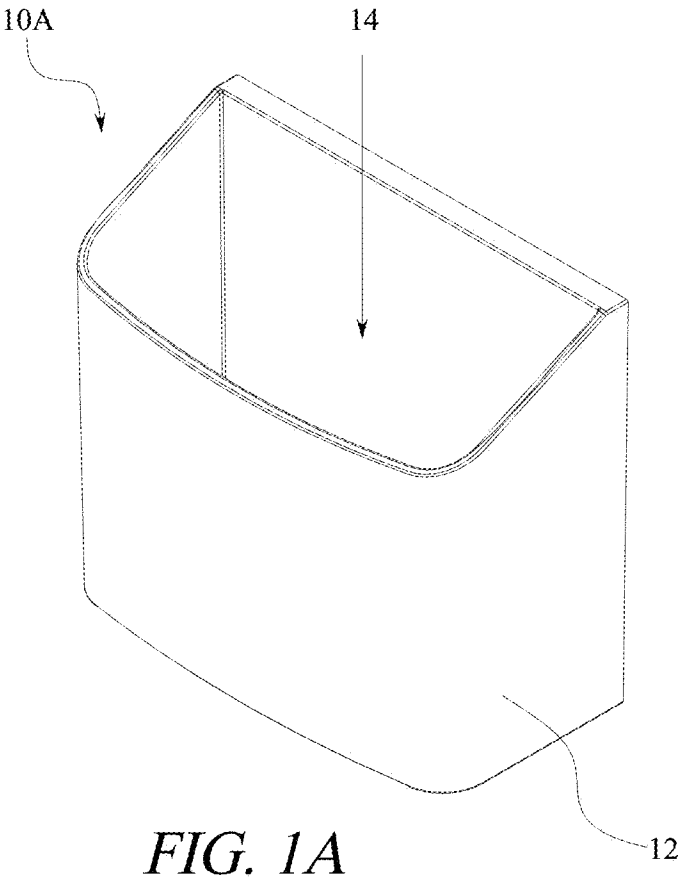

FIGS. 1A and 1B show an embodiment of a modular assembly 10A. The modular assembly 10A can include an article 12, such as a tray or other type of holder, and one or more module 50 coupled to the article 12. In some embodiments, the article 12 can be any object configured to be hung or otherwise mounted vertically and which can include magnet housing portions 18 (e.g., picture frames, shelves, light fixtures, cellphone cases, iPad cases, or other mountable components). The article 12 can include a space 14 for receiving and/or storing materials such as white board markers, glass board markers, chalk, papers, and/or other items (e.g., teaching materials). The space 14 can be enclosed along at least its base and sides (e.g., front, back, and/or lateral sides) and can include an opening (e.g., along the top of the space 14). The article 12 can include a magnet housing portion 18, such as a slot or recess, for receiving the module 50, which will be discussed in further detail below. The magnet housing portion 18 of the article 12 can be disposed on the rear portion 40 of the article 12 or any other suitable location on the article 12. The magnet housing portion 18 can be disposed towards, or at, the center of the rear portion 40 of the article 12. The rear portion 40 and the space 14 can be disposed on opposing sides of the article 12. For example, a wall structure of the article 12 can define one internal surface around the space 14 on a first side and can include one or more mounting zones and/or one or more magnet housing portions 18 on a second side directly opposite the first side. To this end the wall structure of the article 12 can include one or more recesses that are bounded by the second side of the wall structure. This can advantageously allow any magnets housed in the module 50 to be positioned close to the board when the modular assembly 10A is removably attached to a board.

Figure 2B:
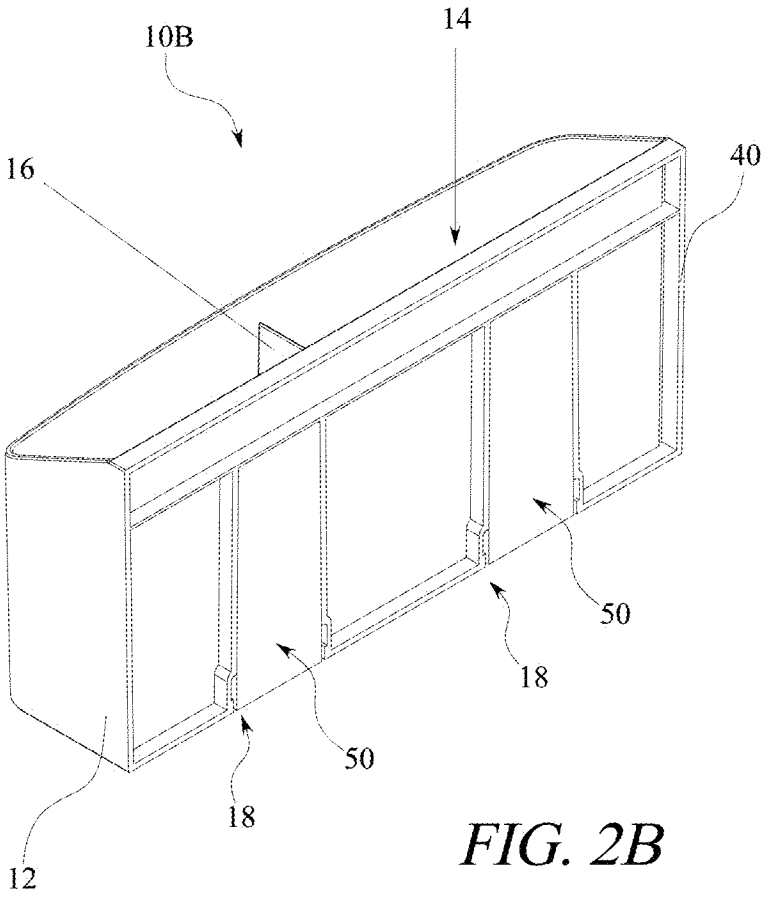
FIGS. 2A and 2B are perspective views of another embodiment of a modular assembly including an article and a plurality of modules.
Figure 2A:
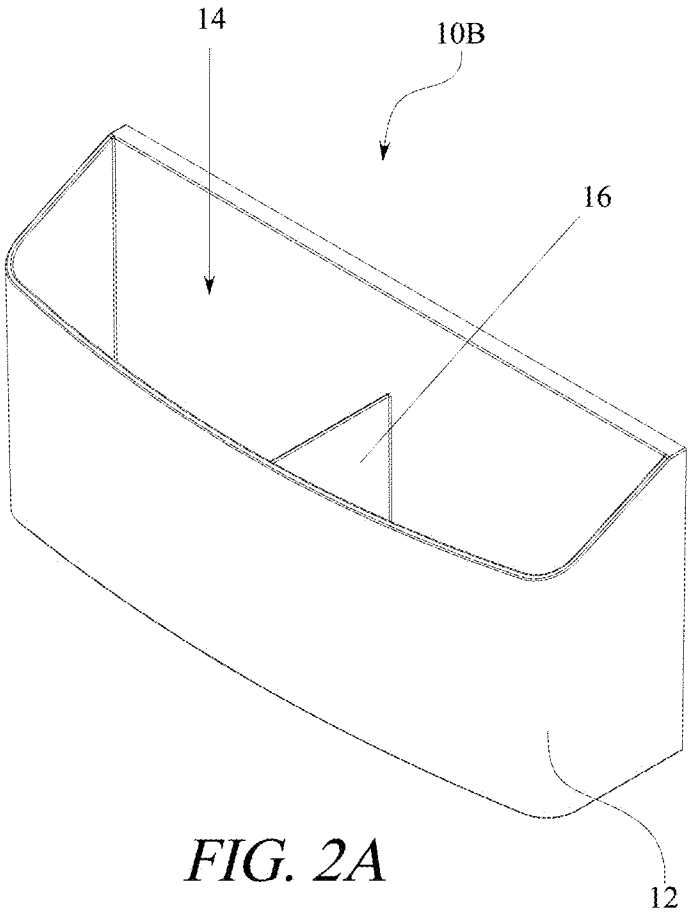

FIGS. 2A and 2B show another embodiment of a modular assembly 10B. The modular assembly 10B can include any of the features described with respect to the modular assembly 10A and the modular assembly 10A can include any of the features described with respect to the modular assembly 10B. As illustrated in FIG. 2B, the article 12 can include a plurality of magnet housing portions 18, such that the article 12 is configured to receive a plurality of modules 50. This can advantageously allow the magnetic strength of the article 12 to be adjustable. For example, one or more module 50 can be coupled to the article 12 as needed to support the weight of the materials being stored in the article 12 and the article 12 itself. Also, if the modules 50 can house more than one magnet, the magnetic strength of the modular assembly 10B can be adjusted in at least two ways, e.g., by including one or more than one magnet in a module 50 and/or by including one module in one of the housing portions 18 and/or by including one of a plurality of modules 50 in each of a corresponding plurality of magnet housing portions 18. The plurality of magnet housing portions 18 can be spaced apart along the length of the rear portion 40 of the article 12 and/or positioned close together (for example, as shown in FIG. 3B).

As shown in FIG. 2A, the article 12 can include a partition 16. The partition 16 can be disposed in the space 14. The partition 16 can act as a divider, creating compartments within the space 14. This can advantageously allow for increased organization of materials stored in the article 12. The partition 16 can be removable such that the space 14 can be customized to fit the user's needs. The partition 16 can extend in a direction perpendicular to the front and rear surfaces of the article 12 and/or parallel to a side surface of the article 12. In one embodiment the number of magnet housing portions 18 can be equal to or greater than the number of partitions 16. A ratio of two magnet housing portions 18 can be provided for each partition 16. In some embodiments, the article 12 may not include a partition 16. The number of magnet housing portions 18 included on an article 12 can vary based on the weight that the modules 50 will need to support (e.g., the weight of the modular assembly 10 and/or the weight of the items stored within the modular assembly 10). For example, the article 12 can include more than one magnet housing portion 18. The article 12 can include less than ten magnet housing portions 18. The article 12 can include one to five magnet housing portions 18.

Figure 3B:
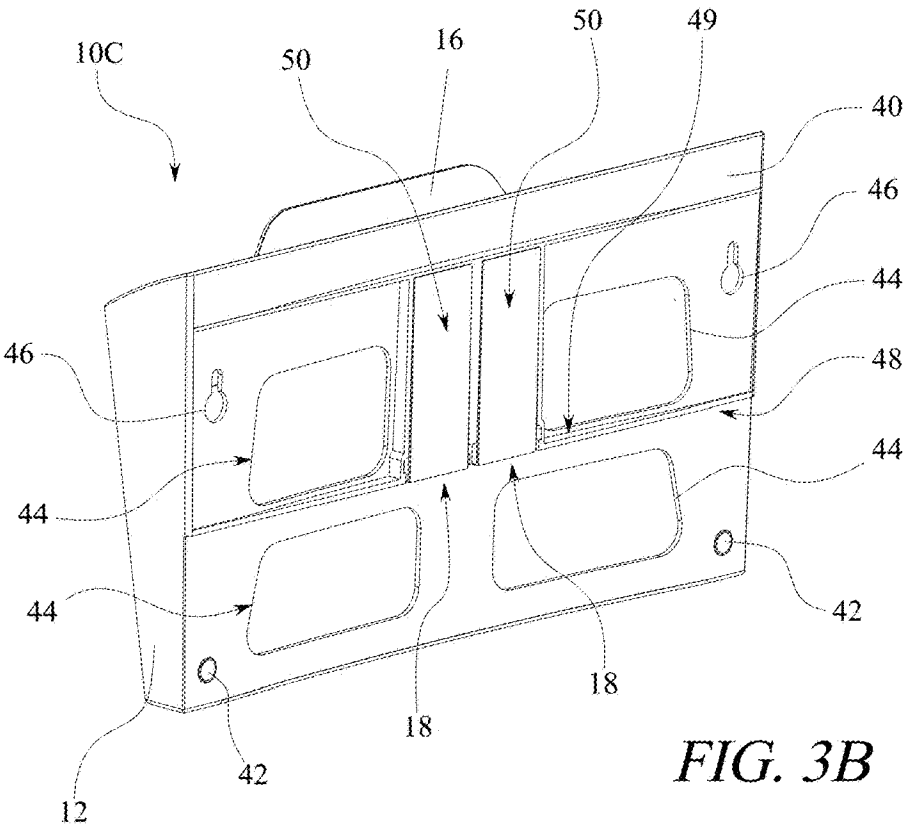
FIGS. 3A and 3B are perspective views of another embodiment of a modular assembly including an article and a plurality of modules.
Figure 3A:
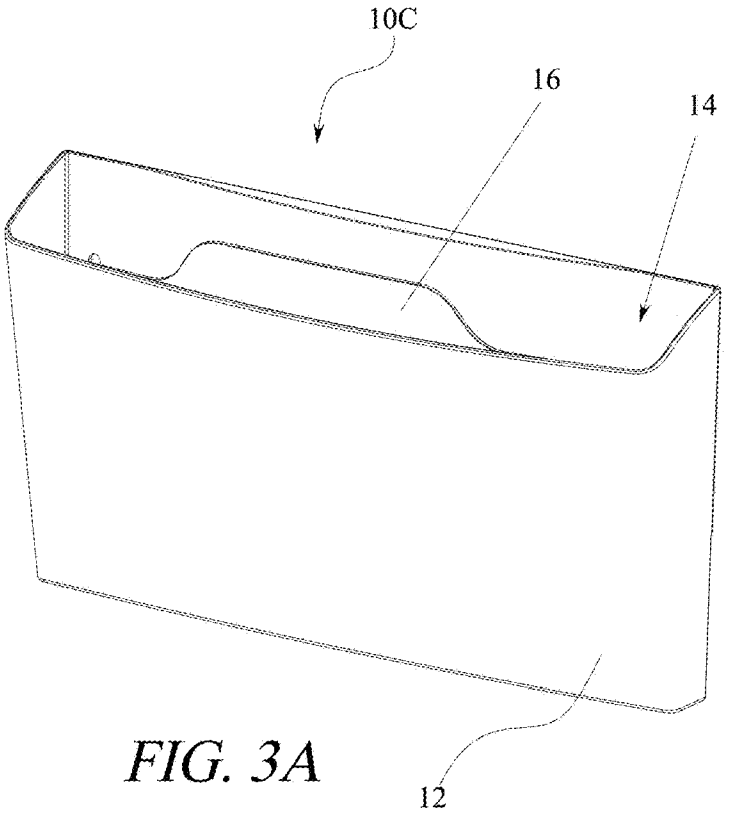
Figure 3D:
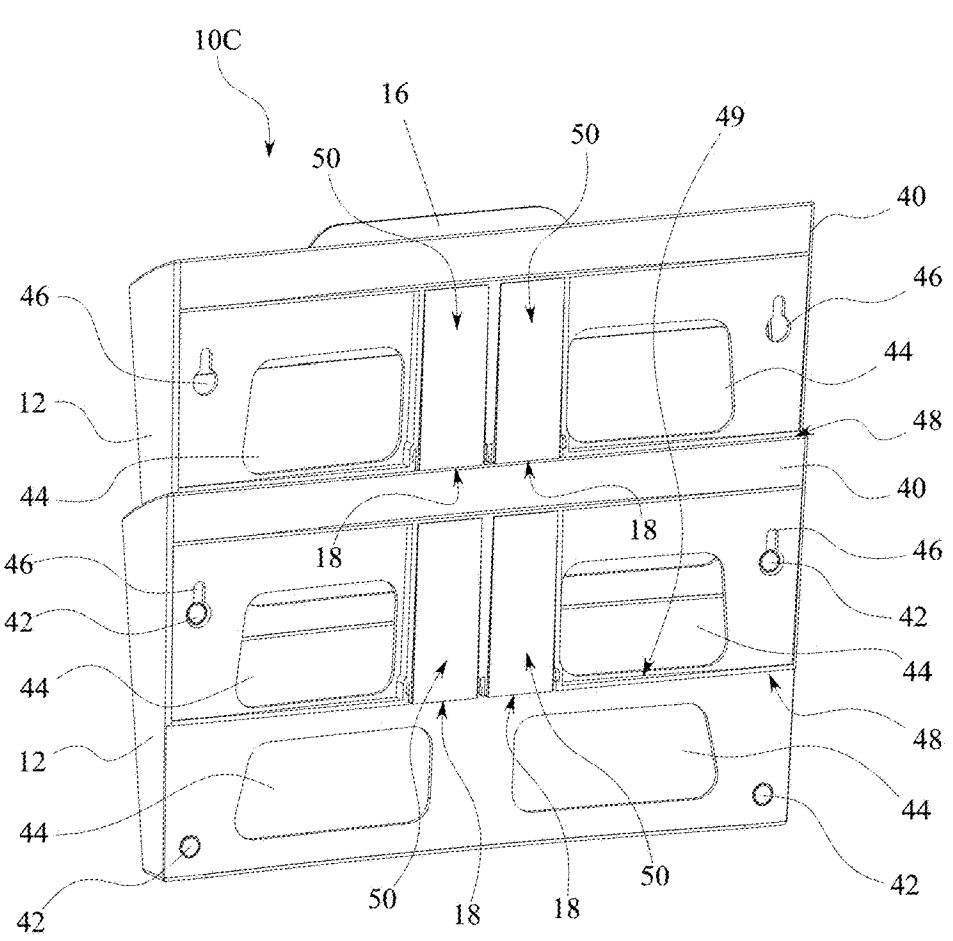
FIGS. 3C and 3D are perspective views of the modular assembly of FIG. 3A nested within another modular assembly.
Figure 3C:
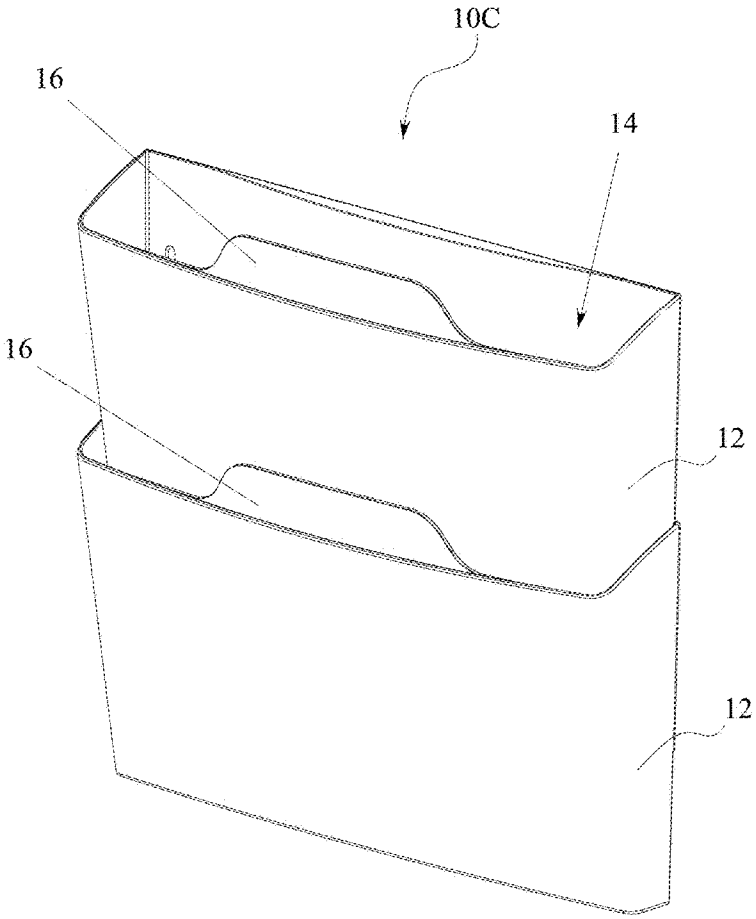

FIGS. 3A-3B illustrate another embodiment of a modular assembly 10C and FIGS. 3C-3D illustrate a method of stacking modular assemblies 10C by nesting one modular assembly 10C in another modular assembly 10C. The modular assembly 10C can include any of the features described with respect to the modular assemblies 10A, 10B and the modular assemblies 10A, 10B can include any of the features described with respect to the modular assembly 10C. In some embodiments, the article 12 can be configured as a soft or hard sided vertical paper file. In some embodiments, the article 12 can be shaped like a folder. For example, the article 12 and/or the space 14 within the article 12 can have a length, width, and/or depth that is suitable for receiving papers, among other items (e.g., a length of at least 11" and/or a depth of at least 8.5"). The space 14 can be compartmentalized using a partition 16 that extends in a direction parallel to the front and rear surfaces of the article 12. For example, the partition 16 can create a forward compartment and a rearward compartment within the space 14. The partition 16 can be moveable to the front of or to the rear of the space 14.

The rear portion 40 of the article 12 can include one or more grip(s) 42. A first grip 42 can be disposed on a first side of the rear portion 40 and a second grip 42 can be disposed on a second side of the rear portion 40 opposite the first side. The grip(s) 42 can be positioned towards the bottom of the rear portion 40 of the article 12. The grip(s) 42 can help stabilize and/or cushion the modular assembly 10C against a product that the modular assembly 10C is removably mounted to (e.g., a white board or glass board). The grip(s) 42 can help protect the product from being damaged by movement and/or repeated contact of a harder surface of the article 12 against the product.

The rear portion 40 of the article 12 can include one or more aperture(s) 44. The apertures 44 can reduce the overall weight of the modular assembly 10C and/or increase the visibility of items stored within the article 12.

The rear portion 40 of the article 12 can include one or more connector(s) 46. The connector(s) 46 can be openings such as teardrop or keyhole mounts, slots, recesses, protrusions, and/or posts. The connector(s) 46 can be configured to receive a fastener, such as a screw. The connector(s) 46 can be positioned on an upper portion of the rear portion 40 of the article 12. A first connector 46 can be disposed on a first side of the rear portion 40 and a second connector 46 can be disposed on a second side of the rear portion 40 opposite the first side. In some embodiments, such as in applications where the object that the modular assembly 10C will be mounted to does not attract magnets, a fastener (e.g., a screw) can be inserted through each connector 46 and into the object to couple the modular assembly 10C to the object without using magnets. The inclusion of both connectors 46 and magnet housing portions 18 on the modular assembly 10C provides the user with magnetic and non-magnetic options for coupling the modular assembly 10C to another object.

The rear portion 40 of the article 12 can include a recessed portion 48. The recessed portion 48 can be positioned beneath the magnet housing portion(s) 18 of the article 12. The width of the article 12 and/or the space 14 within the article 12 can decrease sharply at the interface between the recessed portion 48 and the rest of the rear portion 40 of the article 12. The change in the width of the article 12 along that interface can create a shelf 49 within the space 14 above the recessed portion 48.

The article 12 and/or modular assembly 10C can be configured to couple to another article 12 and/or modular assembly 10C. For example, as illustrated in FIGS. 3C and 3D, the article 12 and/or modular assembly 10C can be nested within and/or stacked on top of another article 12 and/or modular assembly 10C. Stacking two or more modular assemblies 10C can reduce the amount of space that the modular assemblies 10C would otherwise occupy. Stacking two or more modular assemblies 10C can serve as a way to modify the magnetic strength of the overall assembly that is being mounted to another object (e.g., being mounted to a glass board, whiteboard, etc.). For example, a first modular assembly 10C can be nested within a second modular assembly 10C to form a combined modular assembly wherein the magnet housing portion(s) 18 of each modular assembly 10C remain accessible on the rear portions 40 of the respective modular assemblies 10C. In this way, the number of magnet housing portions 18 available to receive modules 50 is greater in the combined assembly than in each of the first and second modular assemblies 10C individually.

The first modular assembly 10C can rest on a shelf 49 in the space 14 of the second modular assembly 10C that is formed by the recessed portion 48 of the second modular assembly 10C. The shelf 49 in the lower of the two modular assemblies 10C supports the bottom of the upper of the two modular assemblies 10C received in the space 14. When so received the magnet housing portions 18 of the upper and the lower modular assemblies 10C are disposed substantially the same distance from the structure to which they may magnetically couple, e.g., in a same vertical plane. The grip(s) 42 of the first modular assembly 10C can be received in the connector(s) 46 of the second modular assembly 10C to limit relative movement between the stacked first and second modular assemblies 10C.

Article and Module Attachment Features

Figure 4:
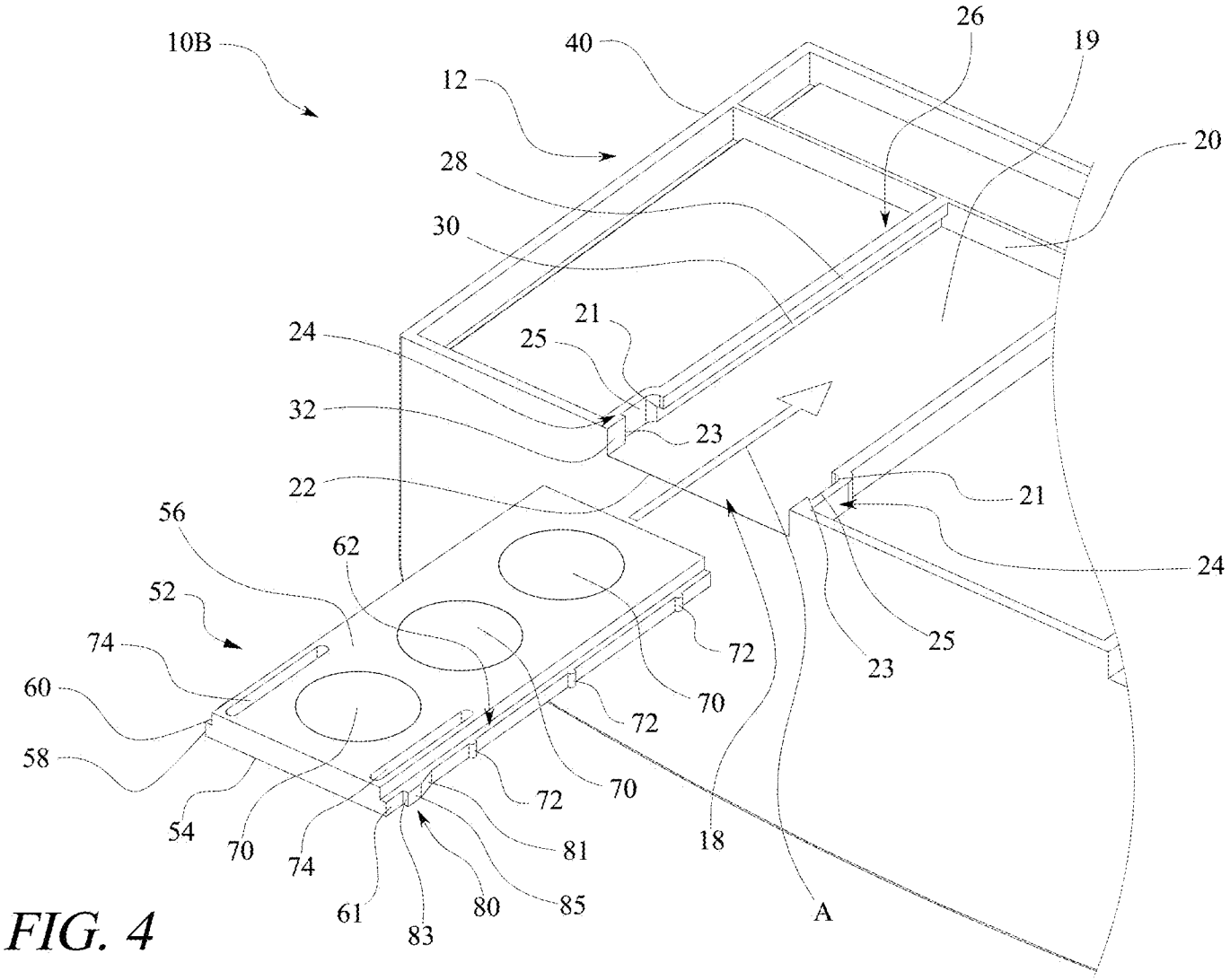
FIG. 4 is a partial exploded view of the modular assembly of FIGS. 2A and 2B showing a module moving in the direction of a magnet housing portion of the article, with the covers of the module omitted to illustrate internal features of the module.

As previously discussed, the modular assembly 10A, 10B, 10C can include an article 12, such as a tray or other holder, for storing materials (e.g., markers, papers, etc.) and a module 50 that houses one or more magnet(s). FIG. 4 illustrates a module 50 being moved in the direction (indicated by arrow A) of a magnet housing portion 18 of an article 12, with optional covers 76, 78 of the module 50 omitted to illustrate features of the magnet housing 52. The magnet housing portion 18 can include a slot, recess, opening, or other shape suitable for receiving the module 50. The magnet housing portion 18 can have a first end or closed end 20 and a second end or open end 22. The magnet housing portion 18 can include a planar surface 19 extending between the closed end 20 and the open end 22. The planar surface 19 of the magnet housing portion 18 can be configured to face a first side 54 of the magnet housing 52 when the module 50 is coupled to the magnet housing portion 18. When the module 50 is coupled to the magnet housing portion 18, a second side 56 of the magnet housing 52, opposite the first side 54, can face away from the article 12 (e.g., towards a surface of another object, such as a white board or glass board, that the article 12 is removably coupled to).

Each of the magnet housing portion 18 and the module 50 can include one or more features to enable the module 50 to couple to the magnet housing portion 18. For example, the magnet housing portion 18 can include one or more magnet housing retention feature(s) 24. The magnet housing portion 18 can include a first magnet housing retention feature 24 disposed on a first side of the magnet housing portion 18 and a second magnet housing retention feature 24 disposed on a second side of the magnet housing portion 18 opposite the first side. The first and second magnet housing retention features 24 can oppose and/or face one another.

The module 50 and/or magnet housing 52 can include one or more article coupling feature(s) 80. The magnet housing 52 can include a first article coupling feature 80 disposed on a first lateral side of the magnet housing 52 and a second article coupling feature 80 disposed on a second lateral side of the magnet housing 52 opposite the first lateral side. The first and second article coupling features 80 can extend away from the remainder of the magnet housing 52.

The magnet housing retention feature(s) 24 can be shaped to conform to and/or engage the article coupling feature(s) 80 of the magnet housing 52. For example, the magnet housing retention feature 24 can include a recess having a first end 21, a second end 23, and a middle portion 25. The first end 21 can include a curved or angled surface. The middle portion 25 can include a flat surface. The second end 23 can include a surface that is perpendicular to the flat surface of the middle portion 25.

The article coupling feature(s) 80 of the magnet housing 52 can be shaped to conform to and/or engage the magnet housing retention feature(s) 24 of the magnet housing portion 18. For example, the article coupling feature 80 can include a projection extending laterally away from a lateral side of the magnet housing 52 (e.g., a lateral side of the first portion 58, second portion 60, and/or rim 66) and having a first surface 81, a second surface 83, and a third surface 85. The first surface 81 can extend at an angle away from the side of the magnet housing 52 (e.g., the side of the first portion 58, second portion 60, and/or rim 66). The second surface 83 can extend perpendicular to the side of the magnet housing 52. The third surface 85 can be flat, extending parallel to the side of the magnet housing 52 and/or perpendicular to the second surface 83.

When the module 50 is coupled to the magnet housing portion 18 of the article 12, the first end 21 of the magnet housing retention feature 24 engages the first surface 81 of the article coupling feature 80, the second end 23 of the retention feature 24 engages the second surface 83 of the coupling feature 80, and the middle portion 25 of the retention feature 24 engages the third surface 85 of the coupling feature 80.

Each of the magnet housing retention feature(s) 24 and the article coupling feature(s) 80 can be spaced apart from an end of the magnet housing portion 18 and an end of the magnet housing 52, respectively. For example, the magnet housing portion 18 can include end surfaces 32 positioned between the open end 22 of the magnet housing portion 18 and each of the magnet housing retention features 24. The module 50 and/or magnet housing 52 can include corresponding end surfaces 61 disposed between each of the article coupling features 80 and the end of the magnet housing 52 closest to the article coupling features 80. When the module 50 is coupled to the magnet housing portion 18, the end surfaces 61 of the module 50 and/or magnet housing 52 face and/or engage the end surfaces 32 of the magnet housing portion 18.

As will be discussed in further detail below, the module 50 and/or magnet housing 52 can include one or more deflectable portions that allow the module 50 and/or magnet housing 52 to deflect so that the module 50 can slide into a secured position in the magnet housing portion 18 of the article 12. For example, the article coupling portion(s) 80 can be deflectable. As the module 50 and/or magnet housing 52 is inserted into the magnet housing portion 18 of the article 12, pressure applied to the article coupling feature 80 by the walls of the magnet housing portion 18 can cause the article coupling feature 80 to deflect or bend inward. The angle of the first surface 81 can enable the article coupling feature 80 of the magnet housing 52 to be more gradually accepted by the magnet housing portion 18. In the absence of an angled surface along the portion of the article coupling feature 80 that enters the magnet housing portion 18 first, the article coupling feature 80 could potentially interfere with the module 50 being able to slide fully into the magnet housing portion 18 (e.g., into contact with the closed end 20 of the magnet housing portion 18). The angled first surface 81 provides a ramp up to the widest portion of the article coupling feature 80 such that the magnet housing portion 18 and the magnet housing retention feature 24 can more easily receive the article coupling feature 80.

The magnet housing portion 18 can include a track 26 configured to guide the module 50 into a secured position. The track 26 can have an outer portion 28 and an inner portion 30. The outer portion 28 can extend over a portion of the planar surface 19 and form a channel, recess, and/or slot between an inner surface of the outer portion 28 and the planar surface 19.

The track 26 can be shaped to receive and/or engage a peripheral portion of the module 50 and/or magnet housing 52. The magnet housing 52 can include an expanse between the first side 54 and the second side 56 of the magnet housing 52. The expanse can include a first portion 58 and a second portion 60. The first portion 58 can extend further laterally than the second portion 60, creating a stepped region 62 between the lateral edge of the first portion 58 and the lateral edge of the second portion 60. As the module 50 and/or the magnet housing 52 is moved into the magnet housing portion 18 of the article 12, the lateral edge of the second portion 60 faces and/or engages the outer portion 28 of the track 26 and the stepped region 62 slides into the slot formed between the outer portion 28 and the planar surface 19, with the lateral edge of the first portion 58 facing and/or engaging the inner portion 30 of the track 26.

Structure of Module

Figure 5C:
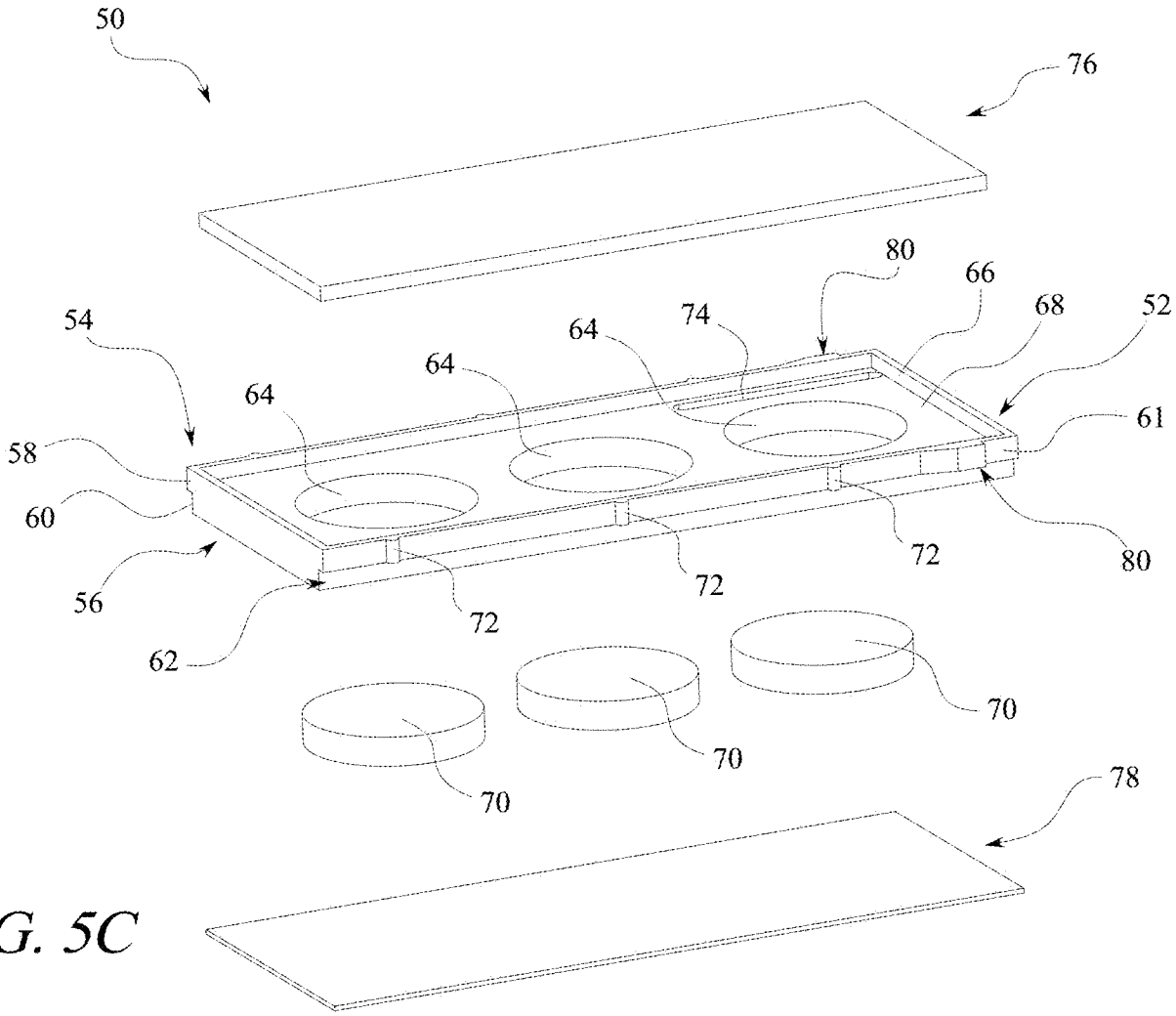
FIG. 5C is an exploded view of the module of FIG. 5A showing a magnet housing, a first cover, a second cover, and a plurality of annular members.
Figure 6B:
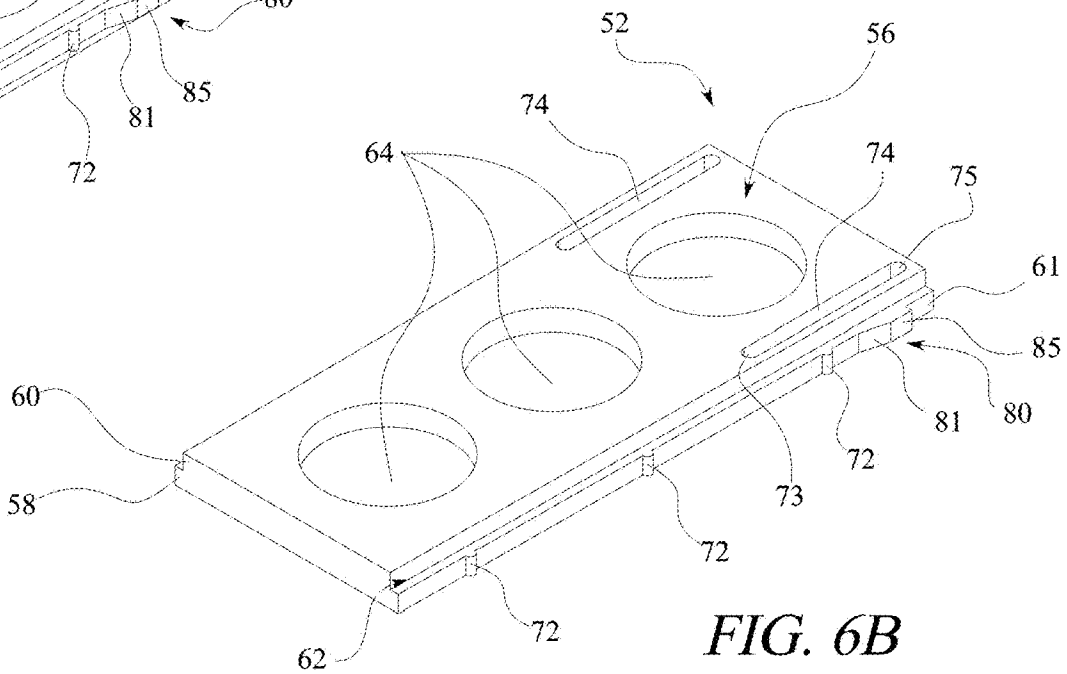
FIGS. 6A and 6B are perspective views of the magnet housing of the module of FIG. 5A.
Figure 6A:
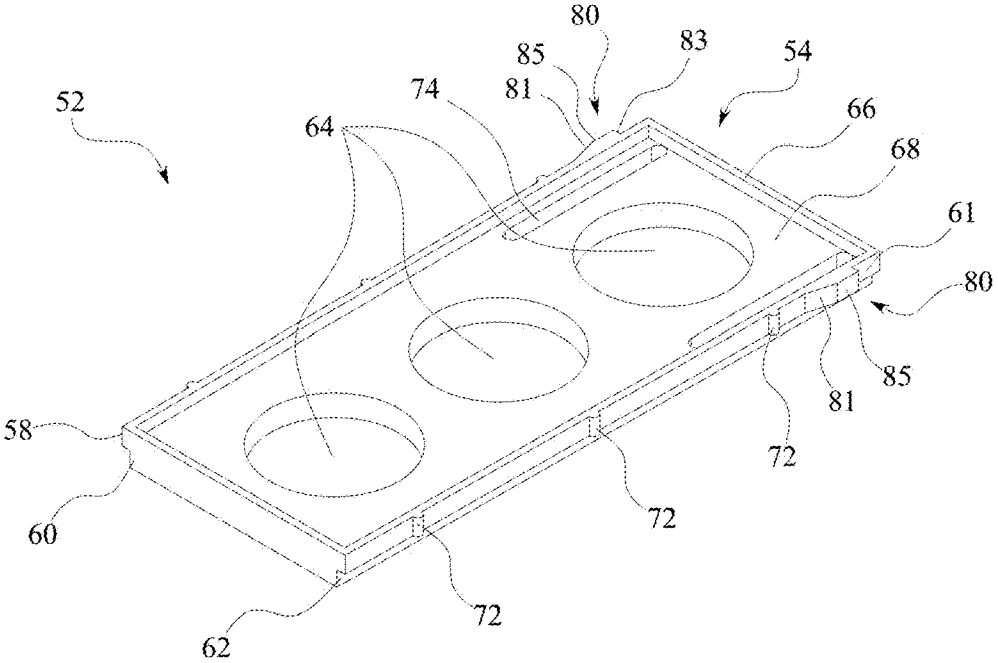

FIGS. 5A-5C illustrate details of the module 50 and FIGS. 6A-6B illustrate details of the magnet housing 52 of the module 50. As shown in FIG. 5C, the module 50 can include a magnet housing 52, one or more annular members 70 (e.g., a plurality of annular members 70) received by the magnet housing 52, a first cover 76 coupled to a first side 54 of the magnet housing 52, and/or a second cover 78 coupled to a second side 56 of the magnet housing 52 opposite the first side 54. In some embodiments, the first cover 76 and/or the second cover 78 are omitted or optional. The first cover 76 can face the planar surface 19 of the magnet housing portion 18 when the module 50 is coupled to the magnet housing portion 18. The first cover 76 can comprise a ferrous material, such as a ferrous plate (e.g., a steel plate), which can attract to the magnetic members 70, focus the magnetic energy forward, reduce the magnetic field on the opposing surface, and/or provide a way for the magnets to attach and form a magnetic circuit. The first cover 76 can be a cover in the sense that it is disposed over one side of one or more magnets in the module 50. The cover 76 need not function as a lid and its description as a cover does not require any specific assembly process or order. The ferrous cover 76 can help retain or in the assembly of the magnetic members 70 in the module 50 using magnetic attraction to the ferrous cover 76 (e.g., steel plate). The second cover 78 can face in a direction away from the modular assembly 10 (e.g., towards the object to which the modular assembly 10 is coupled to or mounted on). The second cover 78 can face the attraction surface of an object to which the modular assembly 10 is coupled to or mounted on. The second cover 78 can comprise a non-slip material. The non-slip material can protect against marring or other damage of the attraction surface of the object and/or reduce shear motion (e.g., sliding or other movement between the rear portion 40 of the modular assembly 10 and the attraction surface of the object).

As shown in FIGS. 5C and 6A, the magnet housing 52 can include a plurality of openings 64 (e.g., two openings, three openings, four openings, five openings, etc.) configured to receive the plurality of annular members 70 (e.g., two members, three members, four members, five members, etc.). The openings 64 can extend partially or entirely through the magnet housing 52. The annular members 70 can be positioned within the openings 64 in the magnet housing 52 and secured in place by the covers 76, 78 being coupled to the first and second sides 54, 56 of the magnet housing 52 and/or by using a type of attachment that is independent of the covers 76, 78 (e.g., a friction fit, etc.).

The members 70 can be magnetic (e.g., lower grade magnetic materials such as Ceramic/Ferrite magnets, higher grade magnetic materials such as Neodymium N30-N54, and/or any grade of magnetic material in between) or non-magnetic. In some cases, the members 70 are magnetic and have a strength of at least 5 MGOe. In some cases, the members 70 are magnetic and have a strength of between 5 MGOe and 53 MGOe. In some cases, the members 70 are magnetic and have a strength of between 10 MGOe and 40 MGOe. In some cases, the members 70 are magnetic and have a strength of between 20 MGOe and 30 MGOe. In some cases, the members 70 are magnetic and have a strength of up to 53 MGOe, e.g., rare earth magnet strength of up to 53 MGOe. In some cases, the members 70 are magnetic and are configured to hold at least 10 times their weight. In some cases, the members 70 are magnetic and are configured to hold 10-50 times their weight. In some cases, the members 70 are magnetic and are configured to hold 20-40 times their weight. In some embodiments, the members 70 can be magnets and/or spacers (non-magnetic) having a round, oval, square, rectangular, or other polygonal or any other suitable shape and the openings 64 in the magnet housing 52 can be similarly shaped. Members 70 having other shapes (e.g., square, rectangular, polygonal, etc.) can include any of the features described with respect to the annular members 70 and can be incorporated in a magnet housing 52 in any of the ways described with respect to the annular members 70.

The magnet housing 52 can house a combination of magnetic and non-magnetic annular members 70. In some embodiments, one or more of the openings 64 in the magnet housing 52 can remain empty (e.g., one or more openings 64 may receive neither a magnetic annular member 70 nor a non-magnetic annular member 70). The magnetic strength of each module 50 can be modified by varying the number of magnetic annular members 70 housed in the magnet housing 52 and/or the grade of the magnetic material of the magnetic annular members 70. For example, a magnet housing 52 can have a plurality of openings 64 (e.g., three openings 64) where one or more of the openings 64 receives a respective magnetic annular member 70 (e.g., a lower grade magnet and/or a higher grade magnet) and the remaining opening(s) 64 either receive a non-magnetic annular member 70 or no annular member 70 at all.

Modifications to the magnetic strength of each module 50 can translate to modifications to the magnetic strength of a modular assembly 10 that includes one or more modules 50 coupled to an article 12. The magnetic strength of the modular assembly 10 can also be modified based on the number of modules 50 coupled to the article 12. For example, an article 12 can include one or more magnet housing portion 18. The magnetic strength of each module 50 that is coupled to a magnet housing portion 18 of an article 12 can be the same as or different from the magnetic strength of the other module(s) 50 that are coupled to the article 12 (e.g., based on the numbers and types of annular members 70 housed in the magnet housings 52 of the modules 50 as previously discussed). In some embodiments, modules 50 may be coupled to some but not all of the magnet housing portions 18 of a given article 12. This can serve as another way to modify the magnetic strength of the modular assembly 10. The adjustability of the magnetic strength of the module 50 and/or the modular assembly 10 can enable the manufacturer or user to customize the modular assembly 10 to suit particular applications. For example, the desired magnetic strength for a modular assembly 10 can vary depending on the type of product that it will be magnetically mounted to (e.g. white board, glass board, steel file cabinet, etc.). While steel is close to the surface of whiteboards and steel file cabinets, the distance between the magnetic surface and steel in magnetic glass boards can exceed 3/16". The desired magnetic strength of the modular assembly 10 can also vary based on the weight of the article 12 and the weight of the materials that will be stored in the article 12. The desired magnetic strength of the modular assembly 10 and/or the strength of each magnet used in the modular assembly 10 can be between 5 MGOe and 53 MGOe.

As previously mentioned, the shape and features of the module 50 and/or the magnet housing 52 enable the module 50 to be received in the magnet housing portion 18 of an article 12. As shown in FIGS. 6A and 6B, the magnet housing 52 has a first side 54 and a second side 56. The magnet housing 52 includes an expanse between the first side 54 and the second side 56. The expanse can include a first portion 58 and a second portion 60. The widths of the first and second portions 58, 60 can be the same or different. The first portion 58 can be wider or narrower than the second portion 60. As shown in FIG. 6A, the first portion 58 can include a rim 66 and a planar surface 68. The rim 66 can extend around the periphery of the first portion 58. The rim 66 can extend in a direction away from the planar surface 68 (e.g., the rim 66 can extend in a direction away from the rest of the magnet housing 52).

The magnet housing 52 can include one or more deflectable portions that allow the module 50 and/or magnet housing 52 to deflect or deform so that the module 50 can slide into a secured position in the magnet housing portion 18 of the article 12. The deflectable portions can reduce the likelihood of damage being caused to the magnet housing portion 18 when the module 50 is coupled to the magnet housing portion 18. The article coupling feature 80, protrusions 72, and/or elongate slots 74 on the magnet housing 52 can be deflectable or otherwise allow the magnet housing 52 to deflect more easily upon insertion of the module 50 into the magnet housing portion 18 of the article 12.

The magnet housing 52 can include a plurality of protrusions 72 along the lateral edges of the magnet housing 52. For example, the plurality of protrusions 72 can be spaced apart along portions of the lengths of the lateral edges of the rim 66. The protrusions 72 can be small, discrete ribs. The protrusions 72 can contribute to a tight fit between the magnet housing 52 and the magnet housing portion 18 while also making it easier to couple the magnet housing 52 to the magnet housing portion 18. For example, the protrusions 72 can provide spaced apart contact points for the magnet housing 52 to interface with the walls of the magnet housing portion 18, which can reduce friction between the magnet housing 52 and the magnet housing portion 18 and enable the module 50 to slide into the magnet housing portion 18.

The magnet housing 52 can include a plurality of elongate slots 74 that can make the module 50 more deflectable or deformable. The elongate slots 74 can extend partially or entirely through the thickness of the magnet housing 52 (e.g., through the first portion 58 and/or second portion 60). The elongate slots 74 can extend in a direction parallel to the longitudinal axis of the magnet housing 52. The elongate slots 74 can extend along at least 20% of the length of the magnet housing 52. Each elongate slot 74 can be formed in the planar surface 68 and positioned between an article coupling portion 80 and an opening 64. The elongate slot 74 can be spaced apart from the article coupling portion 80 and can facilitate the article coupling portion 80 bending inward when pressure is applied to the article couple portion 80 by a surface of the magnet housing portion 18 during assembly of the modular assembly 10. The elongate slot 74 can extend along at least a portion of the length of the article coupling portion 80 in the direction of the longitudinal axis of the magnet housing 52. For example the elongate slot 74 can have a first end 73 located forward of the first surface 81 and a second end 75 located rearward of the third surface 85, e.g., rearward of the second surface 83. The article coupling portion 80 can longitudinally overlap a portion of the slot 74.

Figure 7B:
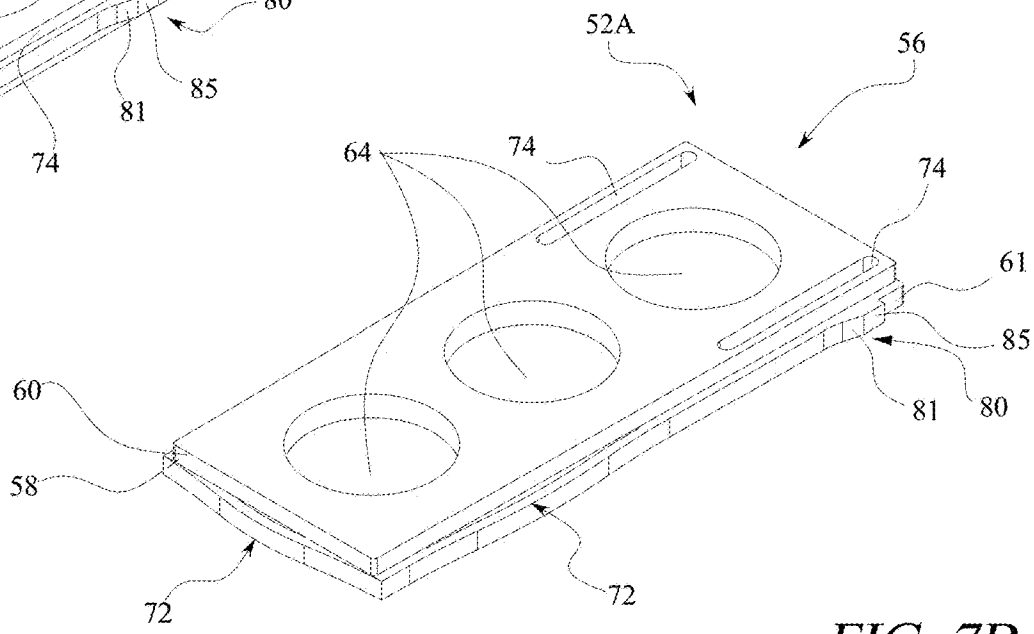
FIGS. 7A-7B and 7C are perspective views of another embodiment of a magnet housing of a module and an elevation view showing the first side of the housing, respectively.
Figure 7A:
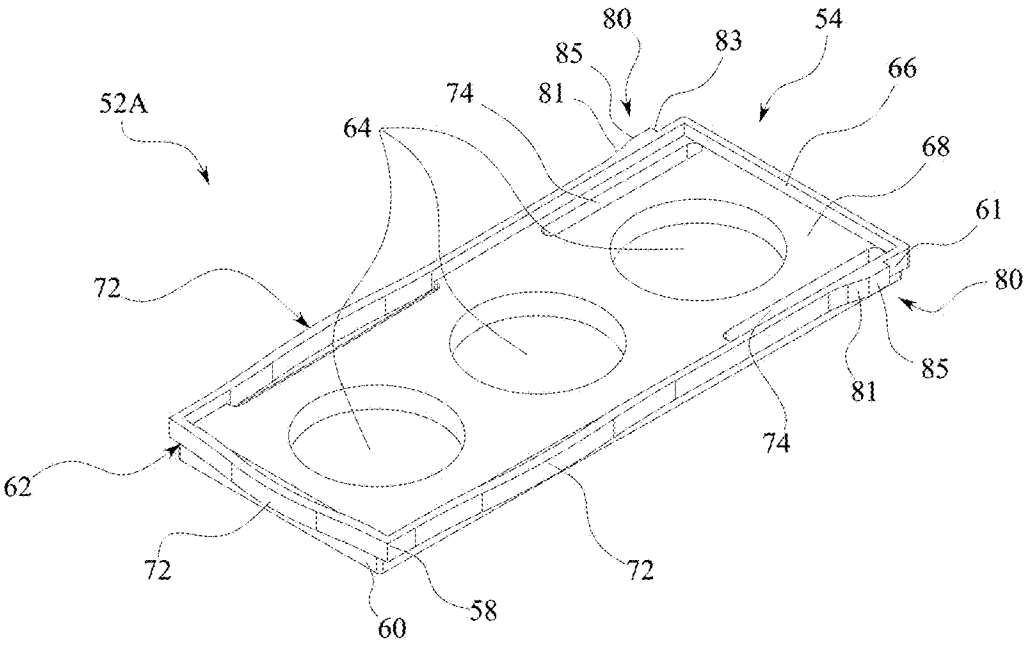
Figure 7C:
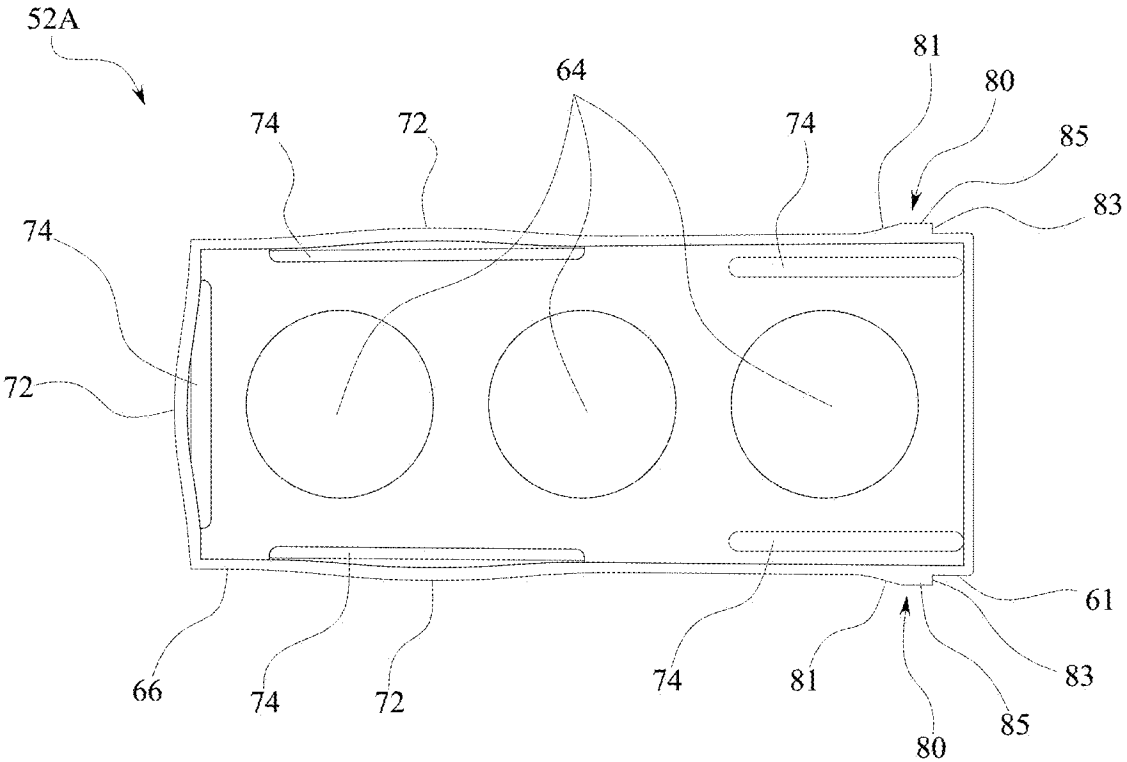

FIGS. 7A-7C illustrate details of another embodiment of a magnet housing 52A that can be incorporated in a module 50. The magnet housing 52A can include any of the features described with respect to the magnet housing 52 and the magnet housing 52 can include any of the features described with respect to the magnet housing 52A. The magnet housing 52A can include protrusions 72 disposed around the periphery of the magnet housing 52A. The protrusions 72 can be curved regions of the rim 66 that extend gradually away from the body of the magnet housing 52A. The protrusions 72 can be disposed on the lateral edges of the magnet housing 52A (e.g., the lateral edges of the rim 66) and/or an end of the magnet housing 52A (e.g., an end of the rim 66).

As illustrated in FIGS. 7A and 7C, elongate slots 74 can be formed in the planar surface 68 adjacent to the protrusions 72 and/or adjacent to the article coupling features 80. The elongate slots 74 can extend at least partially through the first portion 58 and/or the second portion 60 of the magnet housing 52A. The elongate slots 74 positioned adjacent to the protrusions 72 (as shown in FIG. 7C) can have a similar or different shape and/or orientation than the elongate slots 74 positioned adjacent to the article coupling features 80. For example, the elongate slots 74 disposed near the protrusions 72 of the rim 66 can be thinner in a transverse direction and/or longer in a longitudinal direction than the elongate slots 74 disposed near the article coupling features 80. The longer elongate slots disposed near the protrusions 72 are configured to flex more than the elongate slots 74 disposed near the article coupling features 80. The longer the elongate slot 74, the more flexible the slot 74 and/or the regions of the magnet housing 52A adjacent the slot 74. The elongate slots 74 near the protrusions 72 can be longer and more flexible than those near the article coupling features 80 because the amount of force needed to provide a tight fit between the protrusions 72 of the magnet housing 52A and the magnet housing portion 18 (e.g., to reduce rattling or looseness between the components) is less than the amount of force needed to prevent the article coupling features 80 from dislodging relative to the magnet housing retention features 24.

The elongate slot 74 disposed adjacent to the protrusion 72 of the rim 66 on the end of the magnet housing 52A can extend in a direction transverse to the longitudinal axis of the magnet housing 52A (e.g., perpendicular to the direction that each of the other elongate slots 74 extends).

The elongate slots 74 positioned adjacent the protrusions 72 can facilitate the protrusions 72 bending inward when pressure is applied to the protrusions 72 by a surface of the magnet housing portion 18 during assembly of the modular assembly 10. As the protrusions 72 bend or otherwise deform in response to pressure applied to the protrusions 72 during assembly of the modular assembly 10, the protrusions 72 can become loaded in a manner similar to a spring. Furthermore, the bending of the protrusions 72 prevents the magnet housing 52A from loosely fitting in the cavity in which they are disposed in the modular assembly 10 when the width of the housing 52A through the widest portions of the protrusions 72 is greater than the width of the cavity into which the housing 52A is inserted. The protrusions 72 on the lateral sides of the housing 52A are deflected upon insertion into the cavity and in so doing store strain energy, as in a spring. Similarly, as the protrusion 72 at the end of the housing 52A opposite the end with the coupling features 80 engages an end of the cavity into which the housing 52A is inserted the protrusion will store strain energy and will cause a load to be applied between the surface 83 of the coupling feature 80 and the end 23 of the magnet housing retention feature 24. The lengths and shapes of the protrusions 72 on the lateral sides of the rim 66 (as shown in FIGS. 7A-7C) can enable the module 50 to be moved into the magnet housing portion 18 with less force than if the protrusions 72 were shorter and/or extended further or more sharply from the body of the magnet housing 52A.

The protrusions 72 and/or the elongate slots 74 can enable the magnet housing 52A to deflect when the module 50 is inserted in the magnet housing portion 18. For example, in some embodiments, the widest portion of the magnet housing 52A (where the projections 72 on the lateral sides of the rim 66 extend furthest) is about 36 mm wide in a neutral or resting state (i.e., non-deflected state) and the widest portion of the magnet housing portion 18 is about 34.8 mm wide, but the magnet housing 52A can deflect to fit within the magnet housing portion 18.

This can facilitate easier assembly of the modular assembly 10 by making it easier for the module 50 to slide into the magnet housing portion 18 while also enabling a tight fit between the module 50 and the magnet housing portion 18 once the assembly is complete. The protrusion 72 on the end of the magnet housing 52A (e.g., the end of the rim 66) can be placed against the closed end 20 of the magnet housing portion 18 and create tension on the surface 83 of the article coupling feature 80 (which extends perpendicular to the longitudinal axis of the magnet housing 52A and faces the end 23 of the magnet housing retention feature 24). This can reduce relative movement between the module 50 and the magnet housing portion 18 and related noises, such as rattling of the components.

Additional Types of Attachments

FIGS. 8-17 illustrate various types of article coupling features 80A-80J that can be used to attach one or more magnets to an article 12 in addition to, or as an alternative to, the article coupling portion 80 described above.

Figure 8:
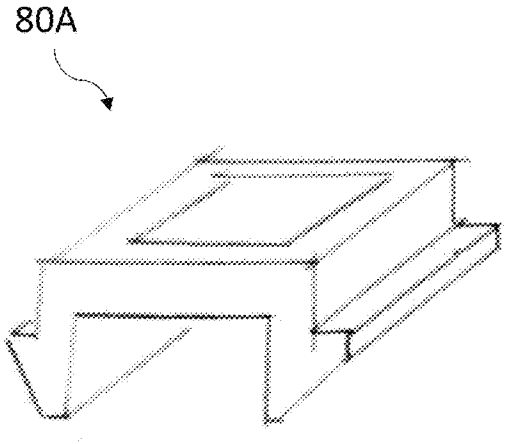
FIGS. 8-17 are perspective views of a variety of embodiments of article coupling features.

FIG. 8 illustrates an article coupling feature 80A. The article coupling feature 80A of the magnet housing can include a snap feature. The magnet housing can hold one or more magnet and snap into a mating component. The magnet housing can be made of plastic and/or metal. The article coupling feature 80A can comprise a protrusion at the end of a cantilever beam that deflects and snaps into a undercut on the mating component. The article coupling feature 80A can be configured to have a low push-in force for ease of assembly and a high separation force.

Figure 9:
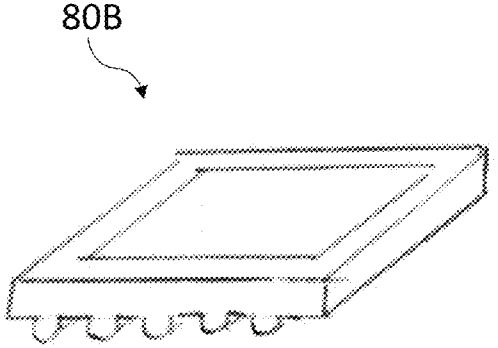

FIG. 9 illustrates an article coupling feature 80B. The magnet housing can hold one or more magnet and be melted onto a mating component using ultrasonic welding (e.g., a localized ultrasonic vibration). The magnet housing and the mating component can be made of plastic. The magnet housing and/or the mating component can have spiked or rounded features configured to focus the energy for a deeper weld penetration.

Figure 10:
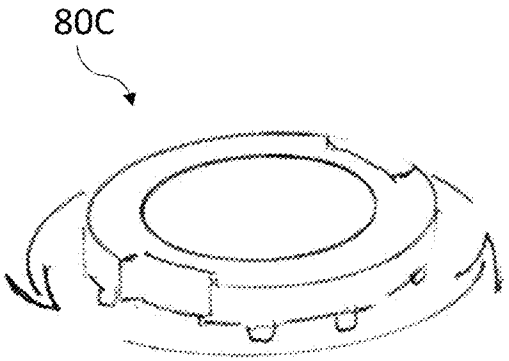

FIG. 10 illustrates an article coupling feature 80C. The magnet housing can hold one or more magnet and be melted onto a mating component using friction created by spinning one or both parts while in contact. The magnet housing and the mating component can be made of plastic. The magnet housing and/or mating component can have spiked or rounded features configured to focus the energy for a deeper weld penetration.

Figure 11:
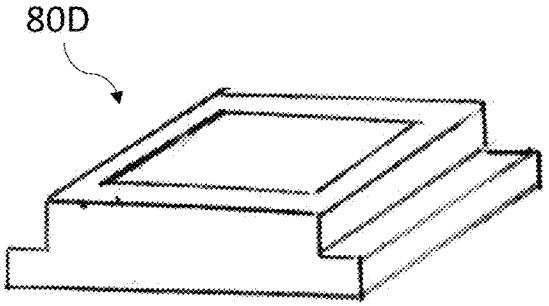

FIG. 11 illustrates an article coupling feature 80D. The magnet housing can hold one or more magnet. The magnet housing can be made of plastic. The magnet housing can be generally T-shaped or trapezoid shaped and fit into a similarly shaped hole. This can allow for movement along only one axis. The "free axis" can be perpendicular to the normal magnetic forces acting on the magnet housing. This "slide-in" may be accompanied by another fastening feature to restrict movement along the "free axis".

Figure 12:
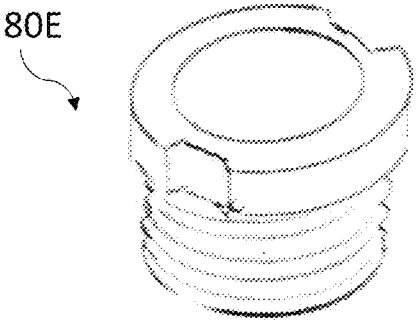

FIG. 12 illustrates an article coupling feature 80E. The article coupling feature 80E of the magnet housing can include a machined thread. Certain magnets (e.g., standard neodymium magnets) can be too brittle to retain machined thread features themselves. The magnet housing can hold one or more magnet and include the machined thread feature. The magnet housing can be made of plastic and/or metal.

Figure 13:
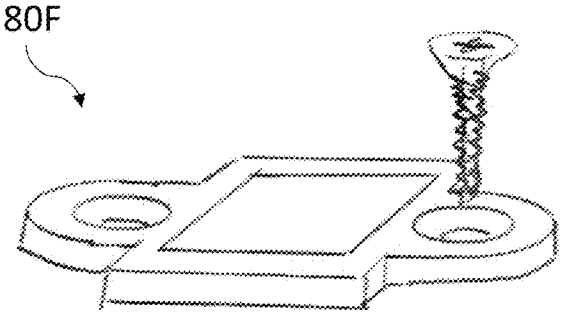

FIG. 13 illustrates an article coupling feature 80F. The article coupling feature 80F can include a fastening feature such as a countersink hole. Machining fastening features such as countersink or counterbore holes into magnets can be costly. Making a fastening feature in an injection molded plastic part can be more cost-effective. The magnet housing can be made of plastic. The magnet housing can hold one or more magnet (e.g., a standard block or disc magnet) and include a fastening feature, such as a countersink hole.

Figure 14:
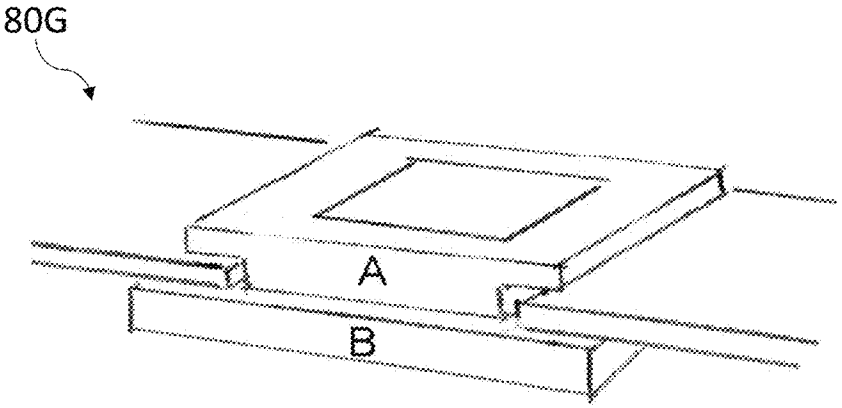

FIG. 14 illustrates an article coupling feature 80G. The article coupling feature 80G can be a pinch retainer. The magnet housing can hold one or more magnet and use the magnet's attractive force to grab or "pinch" onto the edges of a hole. The hole can reduce the gap between the two attracting components, increasing the attraction between the magnet housing (A) and the mating component (B) such that the magnet housing and the mating component remain attached under normal working conditions. The magnet housing can have a greater attraction to the mating component than to any outside force, such as a metal surface or external magnet.

Figure 15:
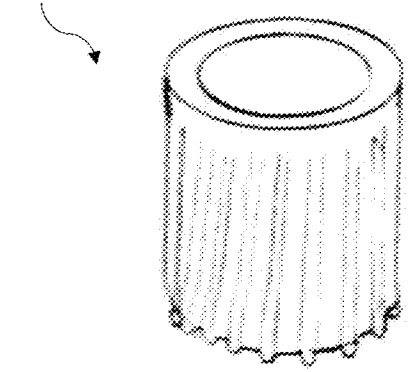

FIG. 15 illustrates an article coupling feature 80H. The article coupling feature 80H can utilize a press fit or interference fit (e.g., by forcing the magnet housing into a small hole such that it is held in place by friction). Neodymium magnets are generally not well suited for press fitting into holes as they are not made to a very high tolerance and are not malleable. The magnet housing can be made to a higher tolerance and/or be malleable enough for press fitting. The magnet housing can be made of plastic and/or metal. The magnet housing can include ridges that are configured to be crushed when pressing the magnet housing into a small hole.

Figure 16:
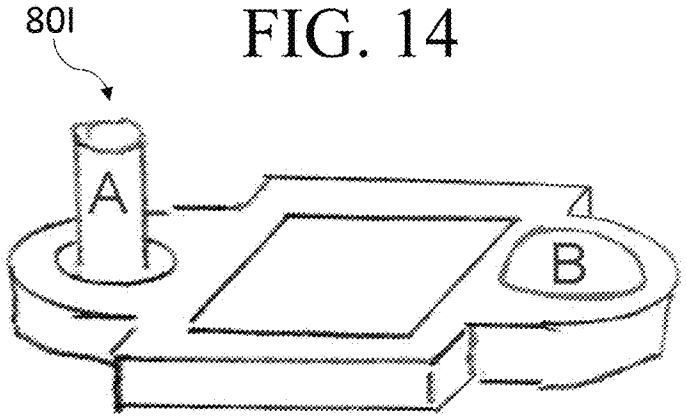

FIG. 16 illustrates an article coupling feature 80I. The article coupling feature 80I of the magnet housing can include heat stakes or melt rivets. This can avoid costly magnet machining. The magnet housing can hold one or more magnet and be made of a low-cost injection molded plastic and/or stamped steel. The heat stake can include a protrusion that sticks up through a hole (A) in the magnet housing. The top of the heat stake can be melted, creating a feature that is wider than the hole (B). The protrusion can be made of plastic.

Figure 17:
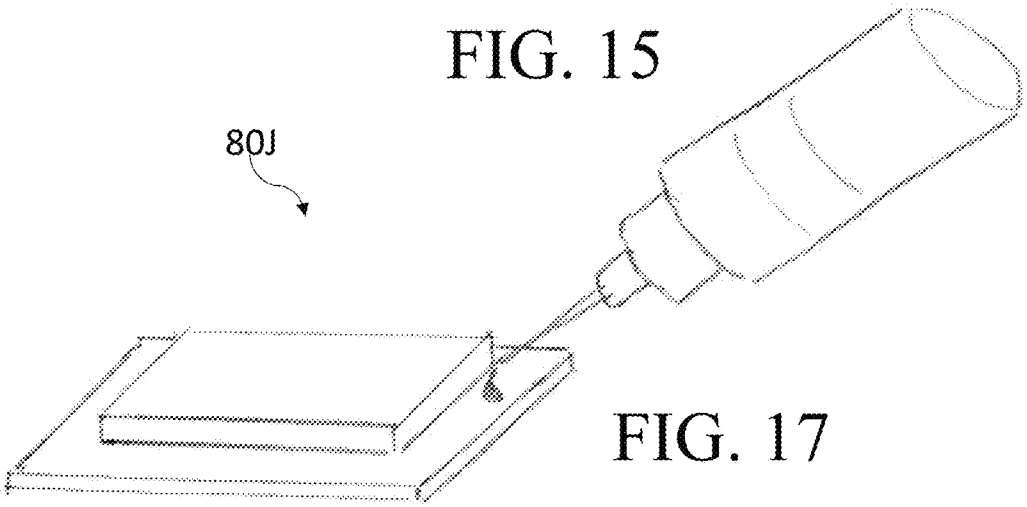

FIG. 17 illustrates an article coupling feature 80J. The article coupling feature 80J can be a glue or solvent bond. Neodymium magnets are generally plated or coated to avoid oxidization. A cheap and commonly used material for plating is Nickel, which is not well suited for gluing as it is smooth. A Nickel surface can be roughed up with sandpaper to enable adhesion. The magnet housing can be made of plastic and/or metal. The magnet housing can have a texture and/or coating that can work with a wide range of glues and solvents. The magnet housing can hold a nickel-plated magnet.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

The terms "approximately," "about," and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

What is claimed is:

1. A modular tray assembly comprising:

a tray comprising:

a storage compartment for storing items; and a plurality of magnetic module holders disposed on a rear portion of the tray, wherein each of the magnetic module holders comprises a slot and a module retention feature; and a plurality of magnetic modules, each of the magnetic modules configured to be coupled to one of the plurality of magnetic module holders of the tray, wherein each of the plurality of magnetic modules comprises:

a magnet housing comprising:

a plurality of apertures;

a first step on a first lateral side of the magnet housing and a second step on a second lateral side of the magnet housing opposite the first lateral side, wherein the first and second steps are configured to be positioned in the slot of the magnetic module holders of the tray;

a tray coupling feature, wherein the tray coupling feature of the magnet housing is configured to be deflected upon insertion of the magnetic module into the magnetic module holder and thereafter to be positioned against the module retention feature of the magnetic module holders of the tray such that the module retention feature blocks egress of the tray coupling feature; and a plurality of deflectable portions that allow the magnet housing to flex under pressure, wherein the plurality of deflectable portions comprises an elongate slot, the elongate slot extending at least partially through a thickness of the magnet housing and being disposed inward of the tray coupling feature; and one or more magnets, wherein each magnet is received in one aperture of the plurality of apertures of the magnet housing.

2. The assembly of claim 1, wherein the plurality of deflectable portions further comprises a plurality of spaced apart projections disposed along one or both of the first and second lateral sides of the magnet housing.

3. The assembly of claim 1, wherein the plurality of deflectable portions further comprises curved protrusions of a rim that extends around a periphery of the magnet housing, wherein the curved protrusions are disposed around at least a portion of the periphery.

4. The assembly of claim 1, wherein one or more aperture is left un-occupied or is occupied by a non-magnetic spacer, wherein each non-magnetic spacer provided is received in one aperture of the plurality of apertures of the magnet housing.

5. The assembly of claim 1, wherein the plurality of deflectable portions further comprises a plurality of ribs disposed along at least a portion of a rim, the rim extending around a periphery of the magnet housing.

6. A magnet housing for coupling magnets to an article, comprising:

a first side;

a second side opposite the first side;

a rim disposed around the first side and/or the second side;

an expanse between the first side and the second side, the expanse having a recess disposed therein, the recess configured to receive a magnet therein;

an article coupling feature configured to engage a magnet housing retention feature of an article; and a plurality of deflectable portions that allow the magnet housing to flex under pressure, wherein the plurality of deflectable portions comprises an elongate slot, the elongate slot extending at least partially through a thickness of the expanse and being disposed inward of the article coupling feature.

7. The magnet housing of claim 6, wherein the expanse comprises a plurality of recesses formed therein, each recess of the plurality of recesses configured to receive a magnet therein.

8. A module comprising:

the magnet housing of claim 7 with one or more magnets received in the plurality of recesses formed in the expanse;

a first cover coupled to the first side of the magnet housing; and a second cover coupled to the second side of the magnet housing.

9. The module of claim 8, wherein one or more recess is left un-occupied or is occupied by a non-magnetic spacer, wherein each non-magnetic spacer provided is received in one recess of the plurality of recesses of the magnet housing.

10. The magnet housing of claim 6, wherein the article coupling feature comprises a mechanical connection.

11. The magnet housing of claim 10, wherein the mechanical connection comprises a snap joint.

12. The magnet housing of claim 6, wherein a length of the expanse is larger than three times a largest dimension of the recess.

13. The magnet housing of claim 6, wherein the expanse comprises a first portion and a second portion, wherein the first portion extends further laterally than the second portion, forming a stepped region along a lateral edge of the magnet housing.

14. The magnet housing of claim 6, wherein the plurality of deflectable portions further comprises a plurality of spaced apart projections disposed along a lateral edge of the magnet housing.

15. The magnet housing of claim 6, wherein the plurality of deflectable portions further comprises a plurality of ribs disposed along the rim around at least a portion of a periphery of the rim.

16. The magnet housing of claim 6, wherein the plurality of deflectable portions further comprises curved protrusions of a rim that extends around a periphery of the magnet housing, wherein the curved protrusions are disposed around at least a portion of the periphery.

* * * * *